United States Patent [19]

O'Connor

[11] Patent Number: 4,876,021

[45] Date of Patent: Oct. 24, 1989

[54] LUBRICATING OIL COMPOSITIONS CONTAINING ANTI-WEAR/ANTI-CORROSION

[75] Inventor: Sean P. O'Connor, Beverley, England

[73] Assignee: BP Chemicals Limited, London, England

[21] Appl. No.: 238,336

[22] PCT Filed: Jan. 14, 1988

[86] PCT No.: PCT/GB88/00023

§ 371 Date: Aug. 26, 1988

§ 102(e) Date: Aug. 26, 1988

[87] PCT Pub. No.: WO88/05459

PCT Pub. Date: Jul. 28, 1988

[30] Foreign Application Priority Data

Jan. 15, 1987 [GB] United Kingdom ..... 8700834

[51] Int. Cl.[4] ..... C10M 135/26; C10M 135/22

[52] U.S. Cl. ..... 252/48.2; 252/48.6

[58] Field of Search ..... 252/48.2, 48.6; 568/20, 568/22

[56] References Cited

U.S. PATENT DOCUMENTS

| | | | |
|---|---|---|---|
| 2,398,202 | 4/1946 | Zublin et al. | 252/48.6 |
| 2,520,748 | 8/1950 | Vaughan et al. | 252/48.6 X |
| 4,250,046 | 2/1981 | Przybylinski | 252/48.2 X |

*Primary Examiner*—William R. Dixon, Jr.
*Assistant Examiner*—Maria Nguyen
*Attorney, Agent, or Firm*—Brooks Haidt Haffner & Delahunty

[57] ABSTRACT

The present invention provided a finished lubricating oil base stock and an extreme pressure/anti-wear improving amount of a bis acyl-or bis aroyldisulphide of the formula

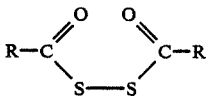

wherein R is independently a hydrocarbyl or substituted hydrocarbyl group.

9 Claims, No Drawings

LUBRICATING OIL COMPOSITIONS CONTAINING ANTI-WEAR/ANTI-CORROSION

The present invention relates to lubricating oil compositions and in particular to lubricating oil compositions containing anti-wear/anti-corrosion additives.

The severe demands placed upon lubricating oils by modern internal combustion engines necessitate incorporation into the lubricating oil of additives of various types, for example dispersants, detergents, anti-oxidants, anti-wear (A.W.) agents, extreme pressure (E.P.) agents, and the like. Generally, each additive agent is employed to impart a particular characteristic to the base oil so as to afford a finished lubricating oil composition which is oxidation resistant, stable and non-corrosive to bearing metals, and which effectively reduces varnish and sludge forming tendencies and minimises frictional and corrosive wear.

The use of zinc dialkyl dithiophosphates (ZDTPs) as additives in lubricating oils for the purpose of improving the wear and corrosion characteristics of the oil has long been known from, for example GB Pat. Nos. 957,017: 1,358,478 and 1,565,961.

Despite the fact that ZDTPs have been very effective and very successful in a number of engine lubricating oils, it is presently considered desirable to replace them with ashless additives for the purpose of reducing environmental pollution.

One class of compound proposed for this purpose are the hydrocarbon polysulphide derivatives of 2,5-dimercapto-1,3,4-thiadiazole having the general formula:

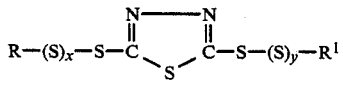

wherein R and $R^1$ are the same or different hydrocarbon radicals, x and y are numbers 0 to about 8, the sum of x and y is at least one, and preferably 2 to about 16. Such compounds are described in U.S. Pat. Nos. 2,719,125; 2,719,126 and 3,663,561. One of these compounds of formula:

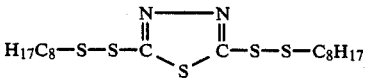

has achieved some commercial importance.

We have now found that bisacyldisulphides and bisaroyldisulphides are another class of compounds which are capable of matching zinc dialkyl dithiophosphates in EP/AW activity and can be non-corrosive to copper.

Accordingly, the present invention provides a finished lubricating oil composition comprising a lubricating oil base stock and an EP/AW improving amount of a bisacyl- or bisaroyldisulphide.

The lubricating oil base stock may be any oil of lubricating viscosity, which may be a mineral oil or a synthetic lubricating oil. Suitable mineral oils include both solvent extracted or solvent refined oils obtained in accordance with conventional methods of treating lubricating oils. The base oil may be derived from paraffinic, naphthenic, asphaltic or mixed base crudes. Alternatively, the base oil may be a synthetic oil, or a mixture thereof with mineral oil.

Bisacyl- or bisaroyldisulphides have the general formula:

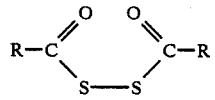

(I)

wherein R is independently a hydrocarbyl or substituted hydrocarbyl group. Suitably the group R may be an alkyl, cycloalkyl, alkenyl, aryl, aralkyl or alkaryl group. Preferably the group R is an aliphatic hydrocarbyl group, more preferably an alkyl group, suitably containing greater than 5, for example, from 5 to 20 carbon atoms. Examples of suitable alkyl groups include n-heptyl, n-pentyl, 2-ethyl pentyl, oleyl ($C_{17}H_{33}$-) and 2-ethylhexyl. An example of a suitable alkenyl group is 9-octadecenyl.

Bisacyldisulphides for use in the compositions of the invention may suitably be prepared by the method described by Kodomari et al in Synthesis, 1981, 637-8. Bisaroyldisulphides may be similarly prepared.

The lubricating oil composition may suitably contain from 0.01 to 10, preferably from 0.1 to 1% w/w of the bisacyl- or bisaroyldisulphide, the remainder of the composition being comprised of the lubricating oil base stock.

In addition, the lubricating oil composition may contain conventional additives, for example dispersants, detergents, VI improvers, anti-oxidants, pour-point depressants, or the like.

Lubricating oil additives are generally manufactured and marketed in the form of a concentrate for subsequent blending into finished lubricating oils.

In another embodiment of the invention there is provided a lubricating oil additive concentrate composition for use in the production of finished lubricating oil compositions as hereinbefore described which comprises a lubricating oil base stock and sufficient of a bisacyl- or bisaroyldisulphide to give a concentration of from 0.01 to 10, preferably from 0.1 to 1%, w/w in the finished lubricating oil composition.

Suitably the concentration of the bisacyl- or bisaroyldisulphide in the concentrate composition may be from 2 to 20, typically about 10, times its concentration in the finished lubricating oil composition. The concentration of bisaroyldisuphides, being much less soluble in general than bisacyldisulphides, will suitably be towards the lower extremity of the aforesaid range. Because of their higher solubility in lubricating oils, bisacyldisulphides are preferred.

The lubricating oil base stock may be any of the aforedescribed lubricating oils, but is preferably a solvent neutral oil.

The invention will now be further described by reference to the following Examples.

PREPARATION OF BISACYLDISULPHIDES

Example 1 —(R in formula (I)=n-heptyl)

An aqueous solution of sodium disulphide was prepared by heating and stirring a mixture of sulphur (2.88 g, 89.8 mmol) and sodium sulphide nonahydrate (21.66 g, 90.18 mmol) in water (140 ml at 90°-100° C. for 20 minutes. The mixture was filtered yielding a red-brown solution which was cooled to room temperature. This was then added dropwise over 20 minutes to a mixture of octanoyl chloride (29.28 g, 180 mmol), hexadecyltrimethyl ammonium bromide, (3.28 g, 9.0 mmol) and toluene (180 ml) maintained at 0° C. with stirring.

Stirring was continued overnight and the reaction mixture was allowed to warm to room temperature. The toluene layer was separated and the aqueous phase further extracted with toluene (4×75 ml). The organic phase was washed with water (100 ml), dried (sodium sulphate) and evaporated yielding off-white waxy crystals (30.7 g). This product was titurated with cold ethanol and filtered giving white crystals. These were recrystallized from methanol yielding the pure bisoctanoyldisulphide (8.7 g, 29% yield) as white plates melting point 36°–38° C.

Analysis: %S Found 20.7; Calc. 20.13 for $C_{16}H_{30}O_2S_2$

Examples 2 to 4

Bisacyldisulphides wherein R in the formula (I) is respectively oleo($C_{17}H_{33}$-), 2-ethylpentyl, and n-pentyl were prepared by the procedure described in Example 1.

PREPARATION OF BISAROYLDISULPHIDES

Examples 5–7

Bisaroyldisulphides wherein R in the formula (I) is respectively phenyl, 4-nitrophenyl and 4-t-butyl phenyl were prepared by the procedure described in Example 1.

The melting points and sulphur contents of the bisacyldisulphides and bisaroyldisulphides produced in Examples 1 to 7 are given in Table 1.

TABLE 1

| Example | R in Formula (I) | Melting Point (°C.) | % Sulphur Found |
|---|---|---|---|
| 1 | n-heptyl | 36–38 | 20.7 |
| 2 | oley/($C_{17}H_{33}$—) | oil | 8.7 |
| 3 | 2-ethylpentyl | oil | 13.0 |
| 4 | n-pentyl | oil | 17.1 |
| 5 | phenyl | 133–135 | 22.1 |
| 6 | 4-nitrophenyl | 161–165 | 18.0 |
| 7 | 4-t-butylphenyl | 133–135 | 16.0 |

PRODUCT TESTING

Examples 8–12

Solutions of the bisacyldisulphides and bisaroyldisulphides prepared as above in LP501 (150 Solvent Neutral (SN) base oil) were made up and the anti-wear properties of these solutions were tested using the Shell (RTM) four-ball test. The copper strip ratings of the solutions were also determined at 150° C. after 3 h in conventional manner.

The four-ball test involved pressing a rotating steel ball against a triangle of three stationary balls lubricated with the test oil. The scar diameters (40 Kg/1 hour) were determined.

The results of the four-ball test and the copper strip rating determinations are given in Table 2.

Comparison Test A

The procedure of Examples 8–14 was used except that no additive was used.

Comparison Test B

The procedure of Examples 8–14 was repeated except that instead of the bisacyldisulphide or bisaroyldisulphide there was used a 1% w/w solution of a commercially available zinc dialkyl dithiophosphate.

Comparison Test C

Comparison Test B was repeated using a different commercially available zinc dialkyl dithiophosphate.

The results for the Comparison Tests are given in Table 2.

TABLE 2

| Example | Compound of formula (I) employed | Concentration (% w/w) | 4-Ball 40 Kg/1 hour scar diameter | Copper Strip rating 150° C./3 hour |
|---|---|---|---|---|
| Comp Test A | — | — | 1.80 | 3A |
| 8 | Ex. 1 | 1.0 | 0.68 | 4B |
| | | 0.1 | 1.04 | 4A |
| 9 | Ex. 2 | 0.1 | 0.80 | 3B |
| 10 | Ex. 3 | 0.16 | 0.93 | 2A |
| 11 | Ex. 4 | 0.14 | 0.70 | 4C |
| Comp Test B | ZDTP | 1.0 | 0.69 | 3A |
| Comp Test C | ZDTP | 1.0 | 0.93 | 3A |
| 12 | Ex. 5 | 0.1 | 0.94 | 3A |

With reference to the above Table, the copper strip ratings are as follows:

1A–1B—Slight tarnish
2A–2E—Moderate tarnish
3A–3B—Dark tarnish
4A–4C—Corrosion

From the results reported in Table 2 it is evident that many of the bisacyldisulphides and bisaroyldisulphides compare favourably with the zinc dialkyl dithiophosphates in the 4-ball test and copper strip test.

I claim:

1. A finished lubricating oil composition comprising a lubricating oil base stock and an extreme pressure/antiwear improving amount of a bisacyl- or bisaroyldisulphide.

2. A finished lubricating oil composition according to claim 1 wherein the bisacyl- or bisaroyldisulphide is present in an amount from 0.01 to 10% w/w.

3. A finished lubricating oil composition according to claim 2 wherein the bisacyl- or bisaroyldisulphide is present in an amount from 0.1 to 1% w/w.

4. A lubricating oil additive concentrate composition which comprises a lubricating oil base stock and a bisacyl- or bisaroyldisulphide additive.

5. A concentrate composition according to claim 4 wherein the bisacyl- or bisaroyldisulphide is of formula:

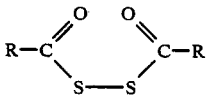

(I)

wherein R is independently a hydrocarbyl or substituted hydrocarbyl group.

6. A concentrate composition according to claim 5 wherein R in the formula (I) is alkyl, cycloalkyl, alkenyl, aryl, aralkyl or alkaryl.

7. A concentrate composition according to claim 6 wherein R in the formula (I) is an alkyl group containing from 5 to 20 carbon atoms.

8. A concentrate composition according to claim 7 wherein R in the formula (I) is n-heptyl, n-pentyl, 2-ethylpentyl, 2-ethylhexyl, oleyl or 9-octadecenyl.

9. A composition according to claim 1 2 or 3 wherein the lubricating oil base stock is a solvent neutral oil.

* * * * *

UNITED STATES PATENT AND TRADEMARK OFFICE

CERTIFICATE OF CORRECTION

PATENT NO. : 4,876,021

DATED : October 24, 1989

INVENTOR(S) : Sean P. O'Connor

It is certified that error appears in the above-identified patent and that said Letters Patent is hereby corrected as shown below:

Col. 1, Title should read after "Anti-wear" --ANTI-CORROSION ADDITIVES--

Col. 2, line 64, should read --in water (140 ml)--

Col. 3, line 37, correct spelling of word --oleyl--

Claim 9, line 1, insert a comma between numbers 1 and 2.

Signed and Sealed this

Twenty-ninth Day of January, 1991

*Attest:*

HARRY F. MANBECK, JR.

*Attesting Officer*

*Commissioner of Patents and Trademarks*